United States Patent [19]

Latone

[11] Patent Number: 4,872,663

[45] Date of Patent: Oct. 10, 1989

[54] SHEET SORTER APPARATUS

[75] Inventor: Salvatore Latone, Rochester, N.Y.

[73] Assignee: M.T.S.L. Associates, Rochester, N.Y.

[21] Appl. No.: 171,492

[22] Filed: Mar. 21, 1988

[51] Int. Cl.[4] ..... B65H 39/10

[52] U.S. Cl. ..... 271/294; 271/292; 271/293

[58] Field of Search ..... 271/292, 293, 294

[56] References Cited

U.S. PATENT DOCUMENTS

| | | | |
|---|---|---|---|
| 3,356,362 | 12/1967 | Mestre . | |
| 3,721,435 | 3/1973 | Zanders . | |
| 3,788,640 | 1/1974 | Stemmle . | |
| 3,879,032 | 4/1975 | Shirahuse . | |
| 3,953,023 | 4/1976 | Cross . | |
| 4,332,377 | 6/1982 | Dubois . | |
| 4,343,463 | 8/1982 | Lawrence . | |
| 4,397,461 | 8/1983 | Dubois . | |
| 4,433,837 | 2/1984 | Romanowski . | |
| 4,466,608 | 8/1984 | Dubois . | |
| 4,466,609 | 8/1984 | Lawrence | 271/293 |
| 4,478,406 | 10/1984 | Dubois . | |

*Primary Examiner*—Kevin P. Shaver
*Assistant Examiner*—Mona C. Beegle
*Attorney, Agent, or Firm*—Martin LuKacher

[57] ABSTRACT

Multiple copies of sheets produced by a copying machine or the like are sorted onto trays. The trays are arranged in a stack and are moved upwardly and downwardly to enable different sheets to be sorted onto the trays on each upward pass and downward pass of the stack. The trays have pairs of pins extending outwardly from opposite side edges into a pair of slots on upright support plates. The walls of these slots support each tray as a cantilever. One of the slots, which is closest the rear edge of the trays, is preferably larger than the other and enables any adjacent trays to be spread apart by lifting and tilting one of the trays so as to provide access between the separated trays for jam clearance and the like. A shifting mechanism moves the trays across a gap into which sheets are dispensed from the copier onto the tray at the underside of the gap. This lifting mechanism is a rotatable assembly which engages the pins and moves a tray across the gap. The mechanism may be implemented by a four bar linkage including crank links and a translational link, having key slots in which the pins are received, and which moves eccentrically and carries a tray across the gap and moves the entire stack of trays upwardly or downwardly together with carriages which are slidably mounted on the support plates and retain the stacked trays.

15 Claims, 5 Drawing Sheets

SHEET SORTER APPARATUS

DESCRIPTION

The present invention relates to sheet sorter apparatus and particularly to a machine for sorting sheets produced by a duplicator, such as a xerographic copier, and arranging or collating the sheets into sets.

The invention is especially suitable for use in providing a low cost, compact sorter which may be associated with a copier by being placed adjacent to the copier to receive duplicated sheets dispensed by the copier.

In compact sorters, a stack of trays is provided for receiving the sheets to be sorted into sets. These trays are closely spaced to each other in a stack. The trays must be separated in order to provide access between them for clearing jams, servicing and maintenance of the sorter. In U.S. Pat. No. 4,433,837 issued to R. F. Romanowski on Feb. 28, 1984 as in other compact sorters, for example the sorter of U.S. Pat. No. 4,332,377 issued June 1, 1982, the rear ends of the trays are in close proximity and may be disposed on racks which limit their accessibility and the extent to which the trays can be separated.

Another problem with compact sorters resides in the mechanism for shifting the trays. Various types of tray shifting mechanisms have been suggested as shown in the above identified patents and also in the following patents which collectively provide the technological background for this invention: U.S. Pat. Nos. 3,356,362 issued Dec. 5, 1967; 3,721,435 issued Mar. 20, 1973; 3,788,640 issued Jan. 29, 1974; 3,879,032 issued Apr. 22, 1975; 3,953,023 issued Apr. 27, 1976; 4,343,463 issued Aug. 10, 1982; 4,397,461 issued Aug. 9, 1983; 4,466,608 issued Aug. 21, 1984; and 4,478,406 issued Oct. 23, 1984. The mechanism provided by this invention serves to shift the trays while they remain supported as cantilevers without any contact or restraint between their free ends, thereby facilitating the use and operation of the sorter.

It is the principal object of the present invention to provide improved sheet sorter apparatus which is easy to operate and use, particularly whenever access to sheets within the sorter is necessary, for example to clear sheets jammed in the sorter for repair, maintenance and other purposes.

It is another object of the present invention to provide an improved sheet sorter which is compact in size so as to be suitable for use with small bench top xerographic copiers or duplicators and which may be fabricated at low cost.

Briefly described, the invention provides apparatus for sorting sheets as they arrive, one at a time from the outlet of a copying machine or the like. The sorter uses a plurality of stacked trays. The trays have pins extending outwardly from the side edges thereof, preferably near the forward end of the trays. The pins are spaced from each other along the side edges. The sorter is supported in a frame having upright support plates disposed along the side edges of the trays. The plates have pairs of slots, generally paralleling each other, into which the pins extend. The slots have walls upon which the pins bear and upon which the trays are supported as cantilevers with the rearward ends of the trays spaced from each other in generally parallel relationship. A tray shifting mechanism is engagable with the pins and moves the trays, one at a time, along the slots through a region adjacent the copier outlet where adjacent ones of the trays are separated so that the sheets are received on the lower one of the separated trays. The mechanism translates the stack of trays, which are retained in a carriage, upwardly or downwardly depending upon the direction in which the trays are shifted through the gap.

The foregoing and other objects, features and advantages of the invention, as well as a presently preferred embodiment thereof, will become more apparent from a reading of the following description in connection with the accompanying drawings in which.

Figure 1:
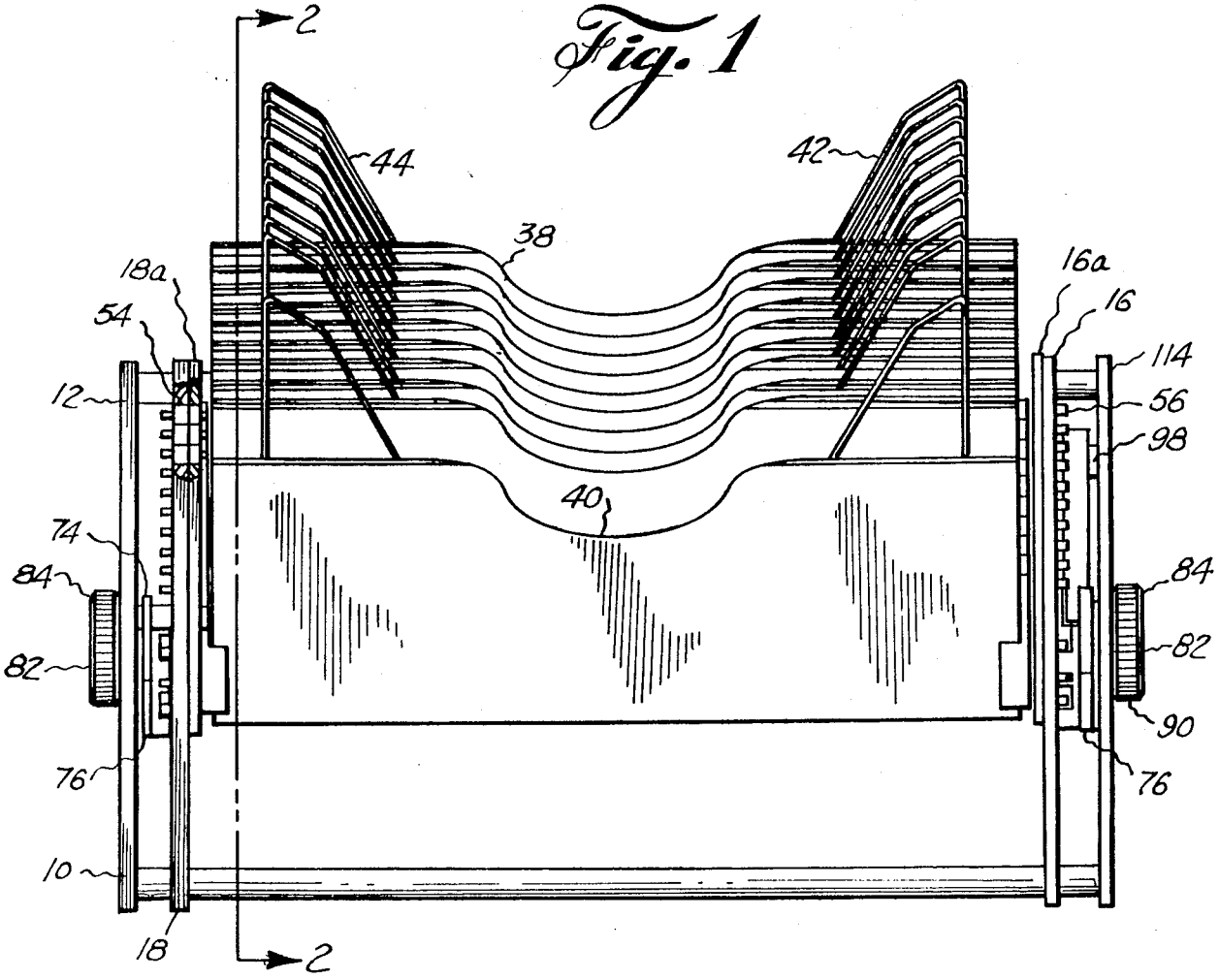
FIG. 1 is an elevational rear view of a sorter embodying the invention.

Referring to the drawings, there is shown a frame 10 having side plates 12 and 14. Inwardly from the side plates 12 and 14 are support plates 16 and 18. The upper parts of these plates may be backed by strengthening plates 16*a* and 18*a*. Each of these support plates, as illustrated for the support plate 16, has a forward slot 20 and a rearward slot 22. These slots are generally parallel to each other. The slot 22 is wider than the slot 20. Each of these slots has an upper portion 20*a* and 22*a*, a lower portion 20*b* and 22*b* and a circular portion 20*c* and 22*c*. The support plates 16 and 18 have carriage members 24 (See FIGS. 2 and 3) slidably mounted in grooves along the edges of the support plates as shown at 27 and 29 in FIG. 3. The carriage members 24 are internally open and are essentially frames having side walls 28 and 30 and top and bottom walls 32 and 34.

Figure 3:
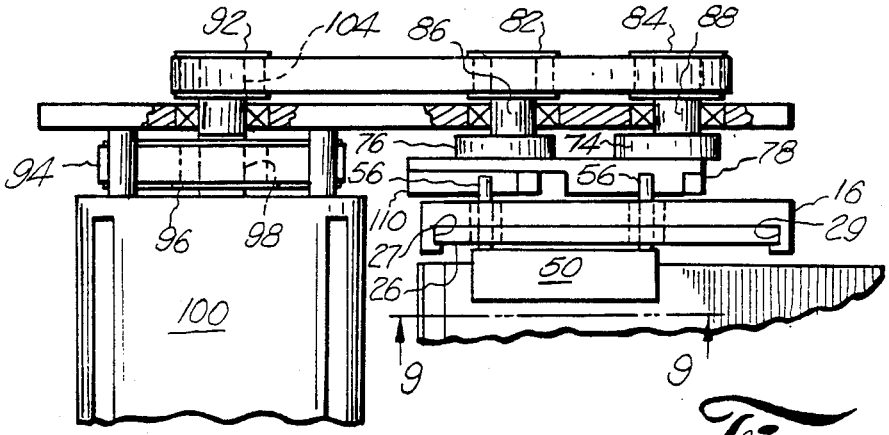
FIG. 3 is a fragmentary top view showing the front end of the sorter shown in FIGS. 1 and 2.
Figure 4:
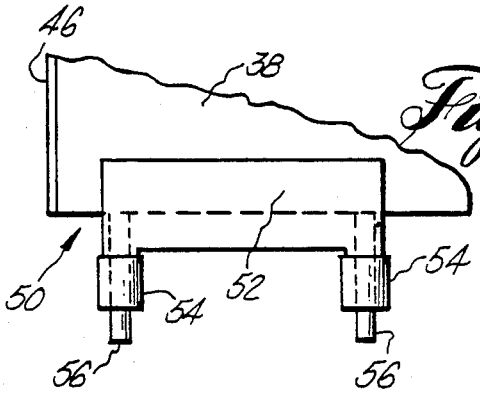
FIG. 4 is a fragmentary view of a typical tray showing a pin assembly thereon.
Figure 5:
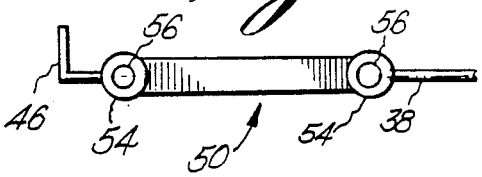
FIG. 5 is an elevational view showing the pin assembly and tray of FIG. 4.

The sorter is shown by way of example with ten trays 38 in stacked relationship. These trays have central indented regions 40 which allow the paper to bow to increase its lateral strength. The trays also have ears 42 and 44 at their rearward ends to restrain the sheets from moving laterally off the trays. These ears can be made of wire, as shown, or can be integral parts of the trays. The trays can be of integral construction, i.e., all plastic, metal or wire forms. The trays also have lips 46 providing L-shaped forward ends to prevent the paper sheets from slipping off the trays from the front thereof. The trays have assembled along the opposite side edges thereof, pin assemblies 50 as best shown in FIGS. 4 and 5. These pin assemblies, which are referred to herein also as "pin means", consist of bars 52 having rollers 54 in which metal pins 56 are inserted. The rollers are spacing rollers which define the distances between adjacent trays 38 in the stack. The rollers also are disposed in the slots 20 and 22. The pins 56 extend outwardly of the support plates 16 and 18 as shown in FIGS. 1 and 3. The diameter of the roller is approximately equal to the diameter of the slot 20; there being sufficient clearance to allow the rollers to translate and rotate in the slots. The rearward one of the roller pairs 54 is spaced so that it bears against the rearward wall 58 of the slot 22. Because the rollers bear against the walls of the slot and rest one upon the other, the trays are cantilevered in the slots so that their rearward ends thereof are free and spaced parallel to each other. Since the rearward slot 22 is displaced vertically upwardly from the forward slots 20, the trays are tilted upwardly toward the rear.

An important feature of the invention is that any tray or stack of trays can be grasped manually and tilted upwardly, pivoting about its forward rollers 54. This enables a large access space to be provided between trays. Paper can be cleared from between the trays and access also had for repair and maintenance purposes.

Figure 2:
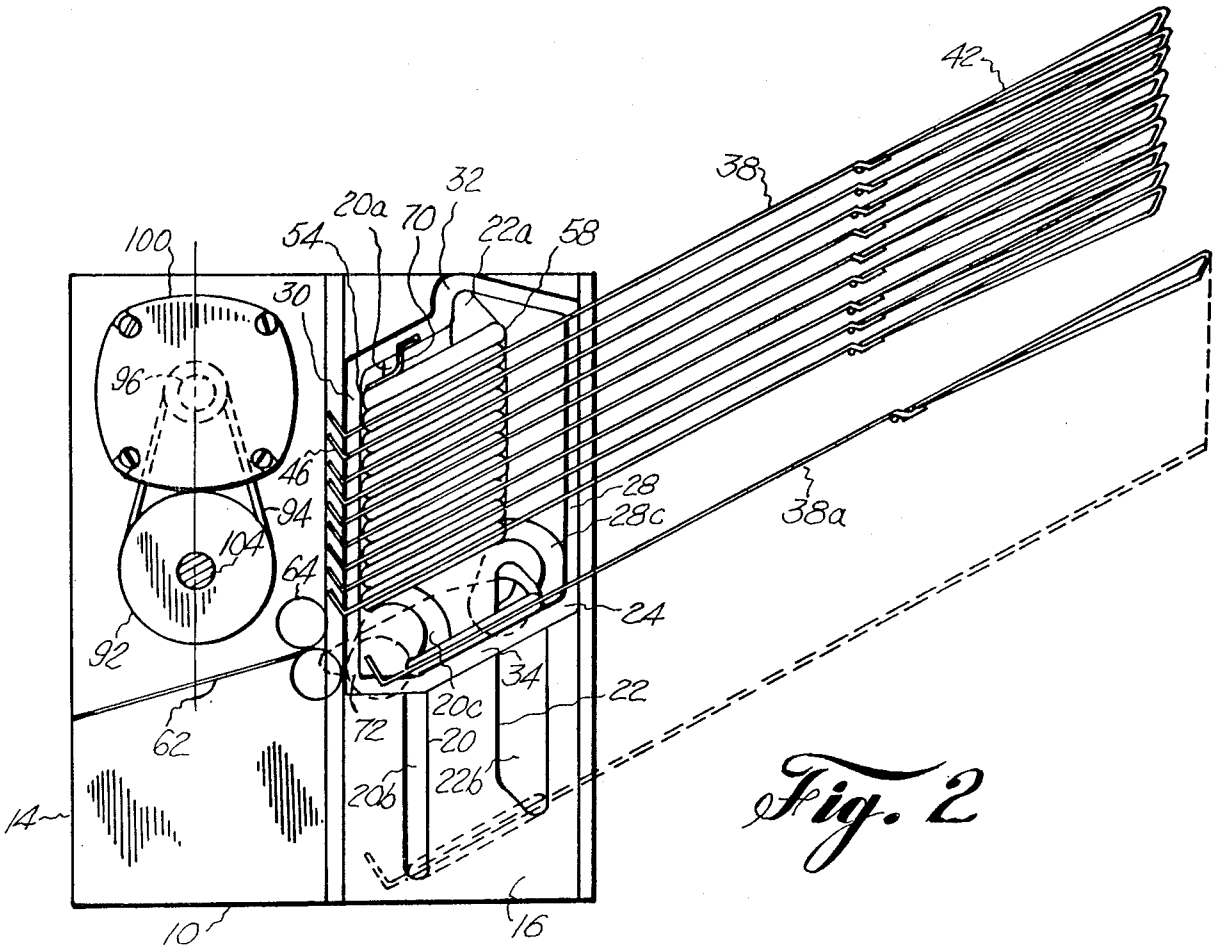
FIG. 2 is a sectional, front elevational view of the sorter shown in FIG. 1, the section being taken along the line 2—2 in FIG. 1.

In effect, the slots provide a dual track along which the stack and trays and individual trays can be moved past a gap defined by the circular portions 20*c* and 22*c* of the slots. The document or copy from the duplicator which is located to the left as shown in FIG. 2 is advanced across a plate 62 between feed rolls 64, which may be motor driven, from the same drive motor which drives the sorter by means of pulleys or other mechanisms (not shown). The outlet of the copier thus is ahead of the plate 62 and of the feed rolls 64. The copy sheet is driven by the rolls onto the tray 38 at the bottom of the gap. This is the tray 38*a* shown in FIG. 2. In the position of the apparatus in the figures, nine of the trays are above the gap and one tray 38 is below the gap. A sorter is assumed to have received a sheet on tray 38*a* which will then be driven upwardly to be the last tray above the gap. In the next operation, the trays will be shifted downwardly, one at a time until all ten trays are below the gap. The stack of trays is driven upwardly and downwardly one at time, so as to collate ten sheets during a downward displacement of the stack and the next ten sheets during an upward displacement of the stack.

The carriage assures that the entire stack will move in unison as a tray is shifted across the gap. The shape of the slots 20 and 22 assures that the stack will be supported. It will be observed from FIG. 8 that the upper portions 20*a* and 22*a* of the vertical slots meet the intermediate circular slots 20*c* and 22*c* at a position past the vertical. Assuming the vertical is at zero degrees, the slot portions 20*a* and 20*c* and 22*a* and 22*c* meet about 15 degrees before zero degrees. The junction of these slots then forms indentations or ledges 66 and 68. The stack of trays is maintained by the carriage on these ledges below the top wall 32 of the carriage. A leaf spring 70, attached to the top wall 32, is engaged with the bars 52 of the pin assemblies 50 and urges the stack against the ledges 66 and 68. There is, of course, a similar mechanism including another spring in the carriage on the side of the machine where the other support plate 18 is located.

The manner in which the entire stack is shifted, and the carriage arrangement for retaining and moving the stack in unison, is similar to the mechanism for the same purpose which is described in the Romanowski Pat. 4,433,837, referenced above.

Figure 6:
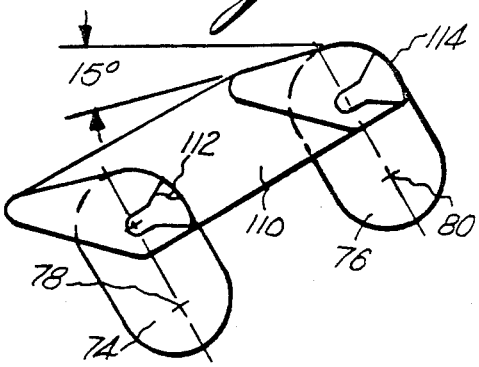
FIG. 6 is an elevational view of the linkage assembly of the tray shifting mechanism used in the sorter shown in FIGS. 1, 2 and 3.
Figure 7:
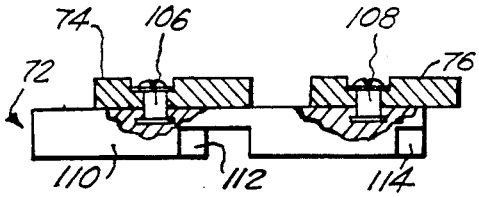
FIG. 7 is a top view of the linkage assembly shown in FIG. 6, the view being shown partially in section so as to illustrate the pivotal connection between links.
Figure 8:
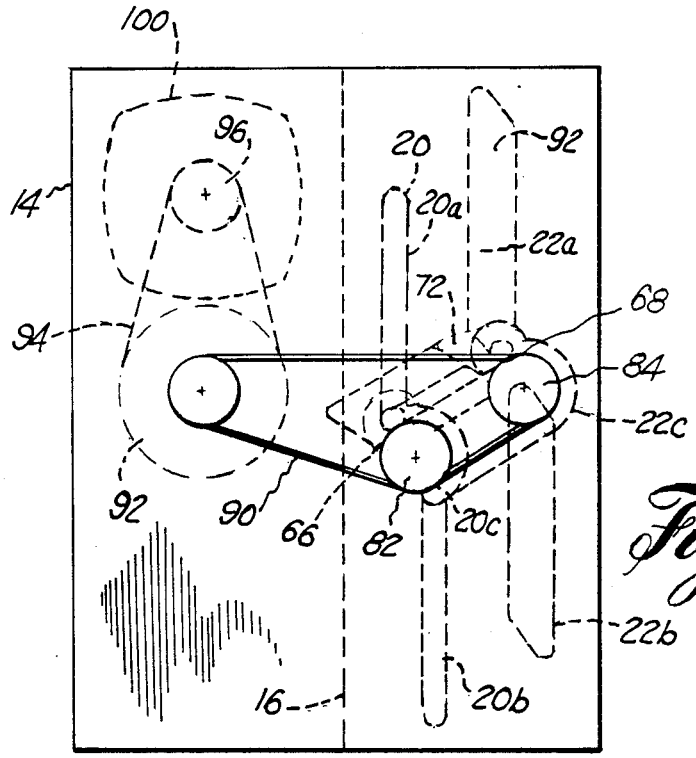
FIG. 8 is a diagrammatic view showing the drive system for the tray shifting mechanism.

The mechanism for shifting the trays is an eccentric translating mechanism provided by a four bar linkage assembly 72 best shown in FIGS. 6 and 7, but also shown in dash lines in FIGS. 2 and 8. The linkage assembly 72 has a pair of crank links 74 and 76 with axes of rotation 78 and 80. These crank links are driven by pulleys 82 and 84 which are connected thereto by shafts 86 and 88. The pulleys are driven synchronously by a belt 90. The belt is entrained also around a dual diameter coaxial drive pulley 92. The drive pulley 92 is driven by another belt 94 which is connected to a pulley 96 on the output shaft 98 of a motor 100. The coaxial pulley 92 has a shaft 104 extending laterally across the copier to the opposite frame wall which is connected through a similar arrangement of belts and pulleys which are identified by like reference numerals.

Returning to the linkage assembly 72, the crank links 74 and 76 are pivotally connected at pin bearings 106 and 108 to a translational link or bar 110. This bar has a cam angle or radius indicated at 15 degrees so as to remain below the upper edge of the support plates 16 and 18. The link 110 is formed with slots or notches (key slots) 112 and 114. These slots have tapered outer regions and a neck which is extends over the pivotal axis of the bearings 106 and 108. The key slots allow positive engagement with tray roller pins (lead-in). The translational link is eccentrically driven about the axes 78 and 80 which are also the axes of the pulleys 82 and 84.

Figure 9A:
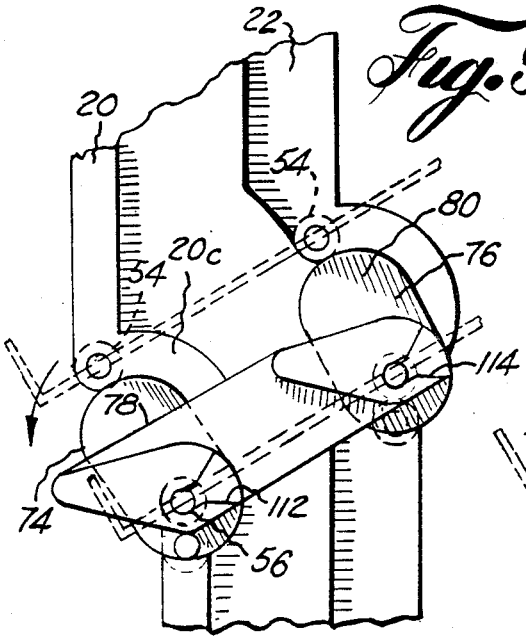
FIGS. 9A, B, C and D illustrates the link mechanism in four positions as it translates a tray upwardly through the gap into which sheets are fed so that they can be received on the tray at the bottom of the gap.
Figure 9B:
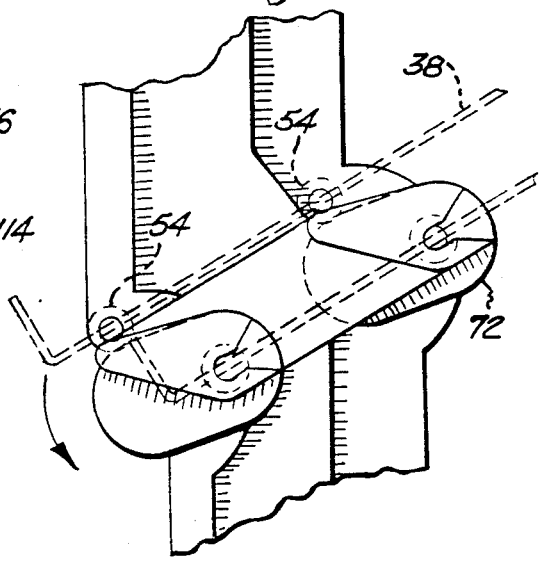
Figure 9C:
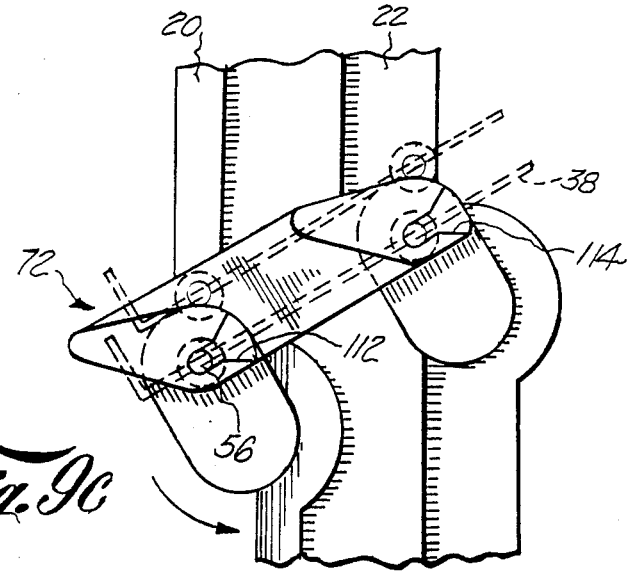
Figure 9D:
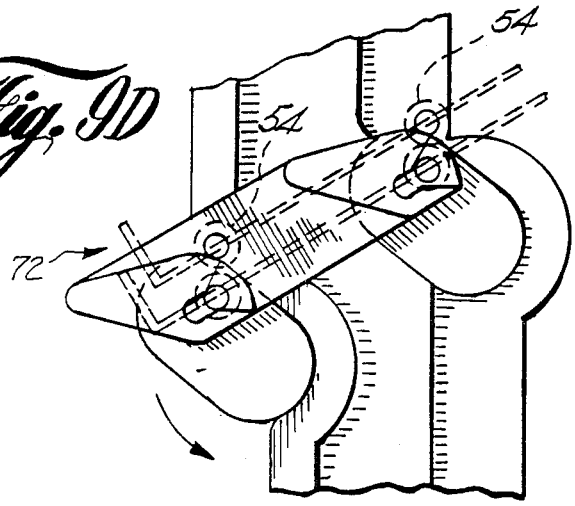

The operation of the shifting mechanism will be apparent from FIGS. 9A to 9D. It will be appreciated that these figures are taken generally along the line 9—9 in FIG. 3. In FIG. 9A the mechanism 72 initiates rotation counterclockwise. The key slots 112 and 114 receive the pins and carry the tray upwardly with the rollers 54 travelling around the intermediate circular portions of the slots 20*c* and 22*c*. The gap between the adjacent trays gradually closes as shown in FIGS. 9B and 9C. As shown in FIG. 9D, the rollers are in engagement and the adjacent trays are spaced apart by the rollers 54, as the key slots leave the pins. The lower rollers are on the ledges 66 and 68 (FIG. 8). By reversing the rotation direction of the mechanism 72 a tray at the bottom of the upper portion of the stack is shifted to the lower portion where it will be retained in the slot portions 20*b* and 22*b* upon the lower wall 34 of the carriage 24.

From the foregoing description, it will be apparent that there has been provided an improved sorter which may readily be implemented at low cost, since it requires only a limited number of parts. The dual track arranged afforded by the slots 20 and 22 maintain the trays in stacked relationship parallel to each other and cantilevered rearwardly for ready access and manipulation. Of course, variations and modifications in the herein described sorter, within the scope of the invention, will undoubtedly suggest themselves to those skilled in the art. Accordingly, the foregoing description should be taken as illustrative and not in an eliminating sense.

I claim:

1. Apparatus for sorting sheets as they arrive, one at a time, from the outlet of a copying machine or the like which apparatus comprises a plurality of stacked trays having a pair of pin means extending outwardly from a side thereof, the pins being spaced from each other along said edge, a frame having an upright support plate disposed along said edge, said plate having a pair of slots generally paralleling each other into which said pin means extend, each of said pair of slots having a slot wall which is opposed to a slot wall of the other of said pair of slots and which define opposed bearing surfaces upon which said pins bear and said trays are supported, the distance between said pin means as measured along a line through their centers to their outer peripheries, being greater than the distance between said bearing surfaces and canted with respect to said slots, and a tray shifting mechanism engagable with said pins for movement of said trays one at a time along tracks defined by said slots through a region adjacent said outlet where adjacent ones of said trays are separated to receive said sheets.

2. The apparatus according to claim 1 wherein said slots are disposed adjacent the forward end of said trays, said trays extending rearwardly in parallel relationship as cantilevers from said slot walls.

3. The apparatus according to claim 2 wherein one of said slots is closer to and the other of said slots is further from said forward end of said trays, at least the other of said slots being wider than said pin means and said trays are pivotal about the pin means thereof in said one slot to enable the separation of said trays to provide access therebetween.

4. The apparatus according to claim 1 wherein said trays have opposite side edges from each of which a pair of spaced pin means extend, another upright support having a pair of slots therein, said upright supports and said slots therein being parallel and each receiving said pair of pin means extending from an opposite edge of said trays, and said pin means of each of said pairs bearing against walls of each of said pairs of slots.

5. The apparatus according to claim 4 wherein said tray shifting mechanism comprises a pair of rotatable assemblies engagable with the pairs of pins extending from opposite side edges of one of said trays at a time for moving it through said region.

6. The apparatus according to claim 1 further comprising a carriage slidably mounted on said support plate and having means for retaining said trays in a stack with which said carriage is movable.

7. The apparatus according to claim 6 wherein said carriage has an opening with end walls on the top and bottom thereof and side walls, said side walls being spaced so that said opening is at least as wide as the separation between said walls of said slots on which said pins bear.

8. Apparatus for sorting sheets as they arrive, one at a time, from the outlet of a copying machine or the like which apparatus comprises a plurality of stacked trays having a pair of pin means extending outwardly from a side edge thereof, the pin means being spaced from each other along said edge, a frame having an upright support plate disposed along said edge, said plate having a pair of slots generally paralleling each other into which said pin means extend, said slots having slot walls upon which said pin means bear and said trays are supported, a tray shifting mechanism engagable with said pin means for movement of said trays one at a time along tracks defined by said slots through a region adjacent said outlet where adjacent ones of said trays are separated to receive said sheets, said slots each have upper and lower and intermediate portions, said intermediate portion being circular and having an upper end which meets said upper portion and a lower end which meets said lower portion, the junction of said upper and said intermediate portion being sufficiently beyond the vertical to define an indentation forming a ledge on which said trays are supportable.

9. The apparatus according to claim 8 wherein the one of said slots which is furthest from the end of said trays which are located forwardly adjacent to said outlet is offset vertically upward from the other of said slots whereby to support said trays with the forward ends thereof tilted downwardly and the rearward ends thereof tilted upwardly.

10. The apparatus according to claim 9 wherein said trays have lips at the forward ends thereof which catch said sheets.

11. Apparatus for sorting sheets as they arrive, one at a time, from the outlet of a copying machine or the like which apparatus comprises a plurality of stacked trays having a pair of pin means extending outwardly from a side edge thereof, the pin means being spaced from each other along said edge, a frame having an upright support plate disposed along said edge, said plate having a pair of slots generally paralleling each other into which said pin means extend, said slots having slot walls upon which said pin means bear and said trays are supported, a tray shifting mechanism engagable with said pin means for movement of said trays one at a time along tracks defined by said slots through a region adjacent said outlet where adjacent ones of said trays are separated to receive said sheets, a carriage slidably mounted on said support plate and having means for retaining said trays in a stack with which said carriage is movable, said carriage having an opening with end walls on the top and bottom thereof and side walls, said side walls being spaced so that said opening is at least as wide as the separation between said walls of said slots on which said pins bear, and means bearing upon said stack of trays from one of said end walls for biasing said trays into stacked relationship.

12. Apparatus for sorting sheets as they arrive, one at a time, from the outlet of a copying machine or the like which apparatus comprises a plurality of stacked trays having a pair of pin means extending outwardly from a side edge thereof, the pin means being spaced from each other along said edge, a frame having an upright support plate disposed along said edge, said plate having a pair of slots generally paralleling each other into which said pin means extend, said slots having slot walls upon which said pin means bear and said trays are supported, a tray shifting mechanism engagable with said pin means for movement of said trays one at a time along tracks defined by said slots through a region adjacent said outlet where adjacent ones of said trays are separated to receive said sheets, and said shifting mechanism comprising a rotatable assembly having eccentrically rotatable members rotatable about an axis transverse to said slots and engagable with said pin means for shifting said trays across said region.

13. The apparatus according to claim 12 wherein said assembly is a linkage having synchronously rotatable crank links each having an axis of rotation, a bar providing a translational link pivotally mounted to said crank links at pivots, the centers of which are offset from the axis of rotation of said crank links, said crank link being said eccentrically rotatable member.

14. The apparatus according to claim 13 wherein said crank links have slots therein extending to said pivot centers for receiving and engaging said pin means as said assembly rotates.

15. The apparatus according to claim 14 wherein said assembly comprises pulleys attached to said crank links for rotating said crank links about the axis of rotation of said crank links, and means for driving said pulleys including a belt engagable with said pulleys whereby to synchronously drive said crank links.

* * * * *